US005974748A

United States Patent [19]

Sciuga et al.

[11] Patent Number: 5,974,748

[45] Date of Patent: Nov. 2, 1999

[54] CORNER INSERT FOR VINYL SIDING

[75] Inventors: Thomas D. Sciuga; Salvatore J. Sciuga, both of Syracuse; Keith J. Tupper, Camillus, all of N.Y.

[73] Assignee: Fit-Z-All Corner Plugs, Solvay, N.Y.

[21] Appl. No.: 08/385,981

[22] Filed: Feb. 9, 1995

[51] Int. Cl.[6] ..... E04C 2/296

[52] U.S. Cl. ..... 52/287.1; 52/101; 52/309.9; 52/404.1; 52/742.12

[58] Field of Search ..... 52/101, 272, 273, 52/276, 278, 279, 287.1, 288.1, 302.7, 309.4, 309.8, 309.9, 404.4, 405.1, 405.2, 406.1, 406.2, 404.1, 574, 610, 730.1, DIG. 15, 741.3, 741.4, 742.1, 742.12; 5/636

[56] References Cited

U.S. PATENT DOCUMENTS

| | | | |
|---|---|---|---|
| 1,521,938 | 1/1925 | Gartenberg | 52/282.1 |
| 3,304,676 | 2/1967 | Sallie et al. | 52/276 |
| 3,816,610 | 6/1974 | Lusby | 52/101 X |
| 3,826,054 | 7/1974 | Culpepper, Jr. | 52/309.8 |
| 3,854,260 | 12/1974 | O'Hanlon | 52/309.8 X |
| 4,189,885 | 2/1980 | Fritz | 52/287.1 |
| 4,196,553 | 4/1980 | Veach | 52/276 |
| 4,319,439 | 3/1982 | Gussow | 52/288.1 |
| 4,542,164 | 9/1985 | Nishioka et al. . | |
| 4,999,961 | 3/1991 | McNary | 52/287.1 |
| 5,090,174 | 2/1992 | Fragale | 52/287.1 X |
| 5,183,695 | 2/1993 | Masuhra et al. . | |
| 5,430,069 | 7/1995 | Ogita et al. | 521/60 |
| 5,542,222 | 8/1996 | Wilson et al. | 52/287.1 |

FOREIGN PATENT DOCUMENTS

| | | | |
|---|---|---|---|
| 83325 | 4/1988 | Japan | 52/101 |

OTHER PUBLICATIONS

*Hawley's Condensed Chemical Dictionary, Eleventh Edition,* pp. 935, 936, 944, & 945.

*Primary Examiner*—Carl D. Friedman
*Assistant Examiner*—Kevin D. Wilkens
*Attorney, Agent, or Firm*—Trapani & Molldrem

[57] ABSTRACT

A foamed plastic insert compresses to fit into the corner moulding or corner piece of vinyl siding or other synthetic siding. The corner piece is formed with an angled web member and undercut flange members offset from the web member and joined to it by sharp bends. The web member and the flanges define a wedge-shaped void, and each of the undercut flanges defines an outward-facing recess to receive ends of the siding members. The insert comprises a resilient L-shaped open- or closed-cell foam member, having legs that compress to fit snugly within respective spaces inside the sharp bends, and defining a V-shaped valley at its back side. When the moulding and inserts are installed, the valley biases against the corner of the sheathing of the frame building beneath the corner moulding. The insert also fills the open interior profile of the moulding. This blocks drafts, dust, moisture and insects from entering the structure through the corner moulding. The inserts can be installed without tools and without need for caulk.

13 Claims, 3 Drawing Sheets

CORNER INSERT FOR VINYL SIDING

BACKGROUND OF THE INVENTION

The present invention relates to building and construction of dwellings and to structures of a residential or commercial nature. The invention is more particularly concerned with siding formed of synthetic material, e.g., vinyl mouldings, and which is applied to the exterior of the structure. This invention is more specifically directed to a sealing insert that is employed in the vertical corner moulding or corner piece to prevent or deter insect intrusion and to reduce drafts and energy losses.

Vinyl siding has become increasingly employed on building exteriors in place of more traditional wood clapboard. Vinyl siding has the desirable attributes of attractive appearance, durability and low maintenance. This material does not need to be painted, and is relatively impervious to wind and rain. This siding is typically applied in horizontal sections to the side of the house or other structure. The edges of the siding sections meet at the corners of the house, and these are concealed in corner mouldings or corner pieces that run vertically, e.g., from the sill plate to the eaves.

The corner mouldings are vinyl extrusions that are open at the top and bottom, and thus are subject to intrusion of drafts of air and to invasion by insects. Some means must be employed as a barrier to deter ants, bees, wasps, hornets, other insects and small animals from intruding and building nests within the building frame. The corner mouldings also have to be closed off to block drafts and reduce heat losses. At present, this is typically accomplished by crimping and stapling the tops and bottoms of the corner pieces, and sealing any remaining cracks with caulk.

There is a need for a simple yet effective barrier against insect and weather intrusion, but which must be relatively permanent (i.e., which will last for as many years as the life of the vinyl siding); which is simple to install, requiring no special tools and no caulk; which is inexpensive; and which permits a wide range of sizes of corner mouldings to be fitted with one size or a small number of sizes of sealing members. Heretofore no one has provided or proposed a suitable sealing member.

OBJECTS AND SUMMARY OF THE INVENTION

Accordingly, it is an object of this invention to provide a suitable insert for corner mouldings which overcomes the drawbacks of the prior art.

It is a more specific object to provide an insert of simple design and low cost that can be installed without tools and which blocks the corner moulding against drafts and insects.

It is another object of the invention to provide an insert that fits a wide variety of profiles of corner pieces or corner mouldings.

It is a further object to provide a corner insert which has a long life, and which can be used in new construction or on existing structures.

In accordance with an aspect of this invention, a corner moulding insert is formed as a resilient, compressible L-shaped foam member, e.g., open- or closed-cell foamed polyethylene. The L-shaped member has leg members that compress to fit snugly within respective spaces defined by sharp bends in the moulding. A V-shaped valley is defined at the back side of the insert between the two leg members. This valley biases against the sheathing of the building beneath the corner moulding. This fills the void within the moulding and presses against the frame to block air drafts, dust, pollen, insect intrusions, and other unwanted elements from entering the building frame through the corner moulding. The inserts can have chamfers at ends of the legs, and preferably can have V-shaped notches at ends of the legs. This foam insert works particularly well with vinyl siding corner mouldings, but can be used with the corner pieces for other types of siding as well.

The above and other objects, features, and advantages of this invention will become apparent from the ensuing description of a preferred embodiment, which should be read in conjunction with the accompanying Drawing.

DETAILED DESCRIPTION OF THE PREFERRED EMBODIMENT

Figure 1:
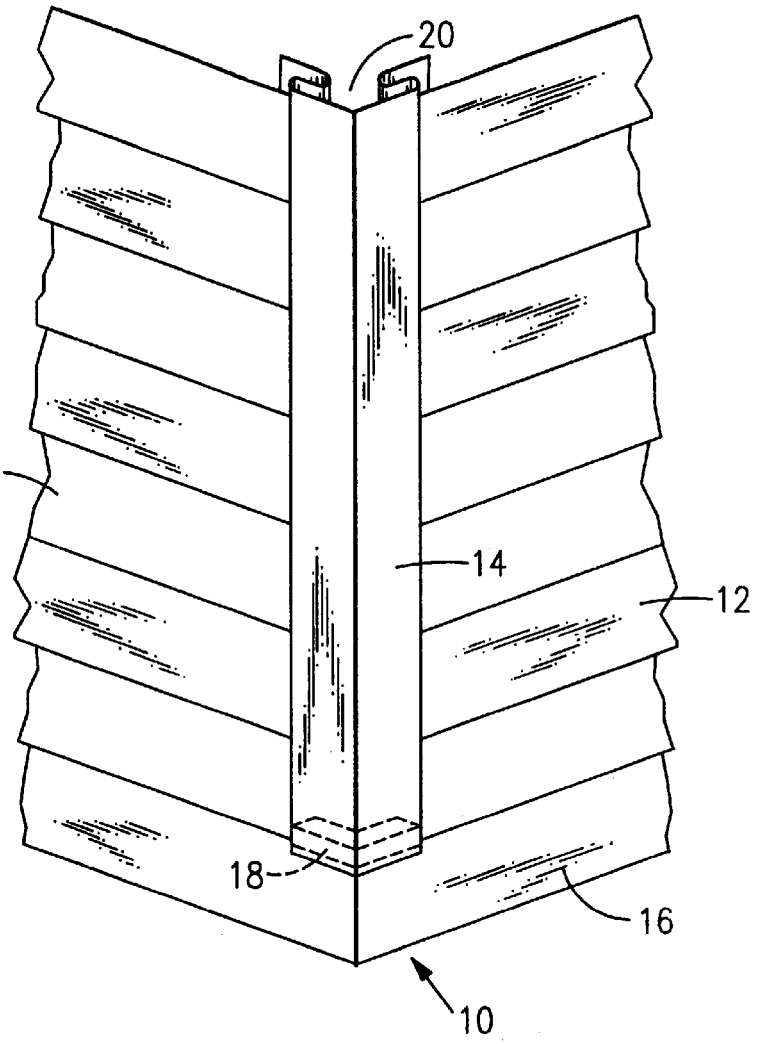
FIG. 1 is a perspective view of a corner portion of a frame dwelling or similar structure, showing vinyl siding and a vinyl corner moulding, with foam inserts according to one embodiment of the present invention.

With reference to the Drawing, FIG. 1 shows a corner 10 of a frame structure such as a dwelling. Vinyl siding 12, here in the form of horizontal members resembling clapboard, are applied to the exterior of the structure. The siding members meet at the corner and their ends are covered by a vertical corner moulding 14, here shown extending upwards from a sill 16 at the base of the structure towards an eave (not shown). An insert 18 (shown in ghost lines) is positioned in a hollow interior 20 of the corner moulding 18 near its lower end. The insert 18 and the corner moulding 14 will be described in greater detail with reference to the remaining Drawing Figures.

Figure 2:
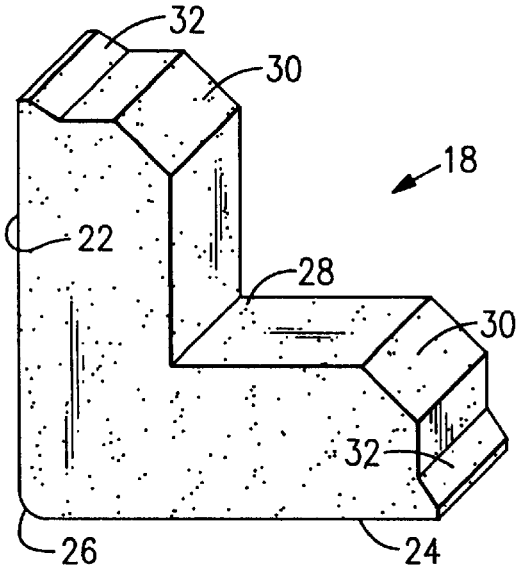
FIG. 2 is a perspective view of a foam insert according to one preferred embodiment of the invention.

A preferred embodiment of the insert 18, shown in FIG. 2, is formed as an L-shaped member of foamed polyethylene, here about 3¼ inches on a side and about 1 inch thick. The polyethylene material preferably includes an ultraviolet stabilizer. The material can be white, black, or colored to match the color of the siding and corner moulding.

Here, the insert 18 is formed with two legs 22, 24 extending at right angles from an outer corner or ridge 26. An inner corner or valley 28 is defined on the inner or back side of the insert, and when the insert and corner moulding are in place, the valley 28 is biased against the sheathing of the structure 10 beneath the moulding 14. At outer ends of the legs 22, 24 chamfers 30 are formed, here on the same side as the valley 28. V-shaped notches 32 are formed at the outer ends of the legs 22, 24 between the front sides and the chamfers 30.

Figure 3:
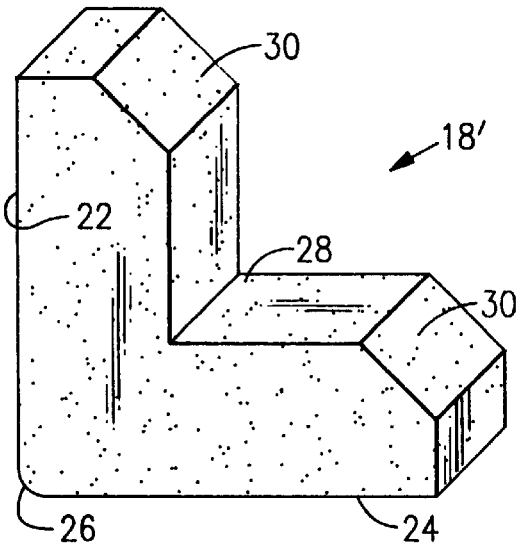
FIG. 3 is a perspective view of a foam insert according to another embodiment of the invention.

An alternative embodiment of insert 18' is shown in FIG. 3, in which features that are also found in FIG. 2 are identified with the same reference numbers. The embodiment of FIG. 3 omits the V-shaped notches 32, but is otherwise similar to the first embodiment.

Figure 4:
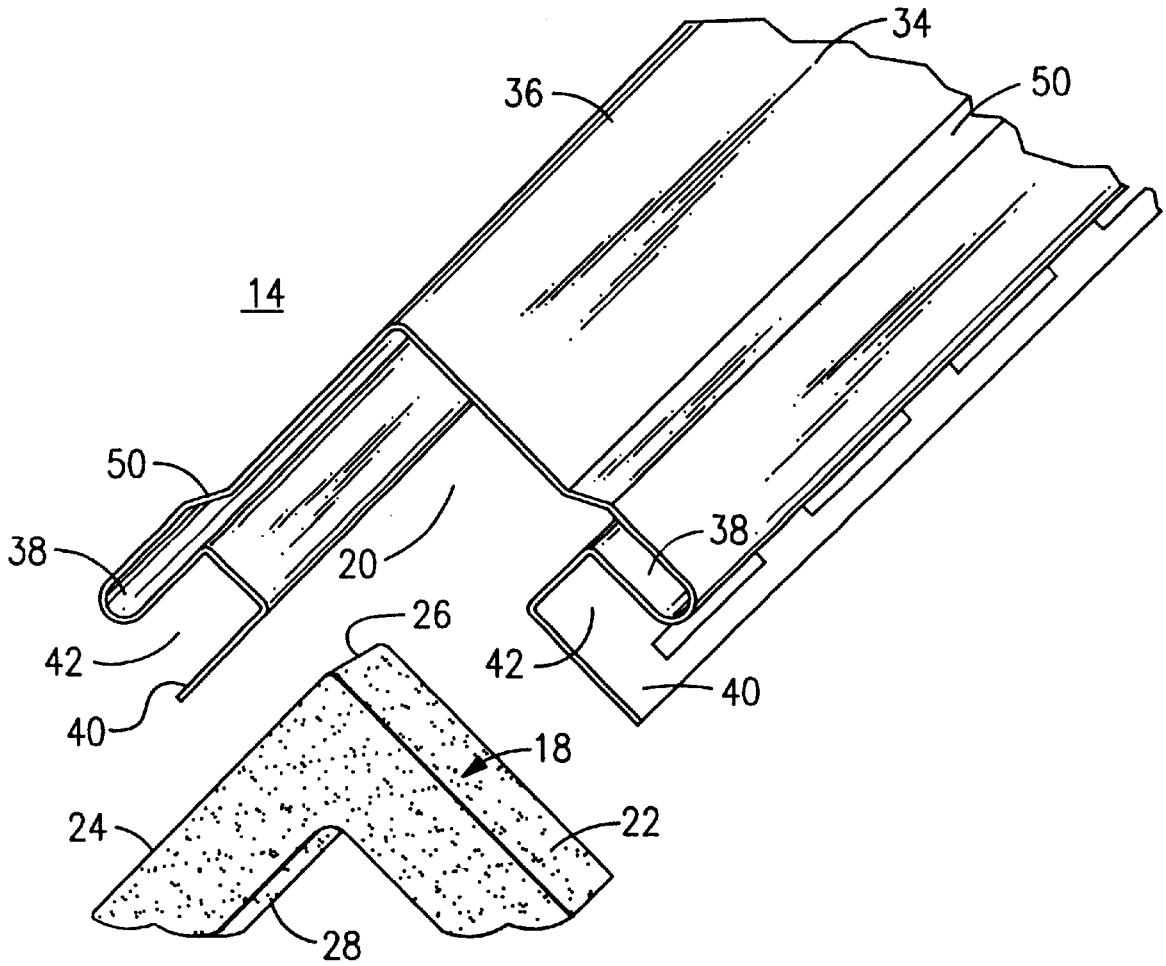
FIG. 4 is partial perspective view showing the insert and one end of a corner moulding.

FIG. 4 shows one end of vinyl corner moulding 14, with its hollow profile 20. The moulding 14 has an angular outer web member 34 with a ninety-degree corner or ridge 36, and sharp bends 38 at its edges. The sharp bends are joined to undercut, offset flange members 40. The flange members have outwardly-facing recesses 42 that receive edges of the siding members 12. The hollow profile or interior 20 is seen to be somewhat wedge-shaped. In this moulding 14, the web member 34 has a decorative crease 50 formed along its length. This is an optional feature, and the insert easily fits mouldings made with or without this crease 50.

The foam insert 18 is flexible and compresses to fit into the hollow interior 20. The insert can be forced into the end of a previously installed corner moulding 14. On new installation, the moulding can be easily flexed to permit simple installation of the inserts.

Figure 5:
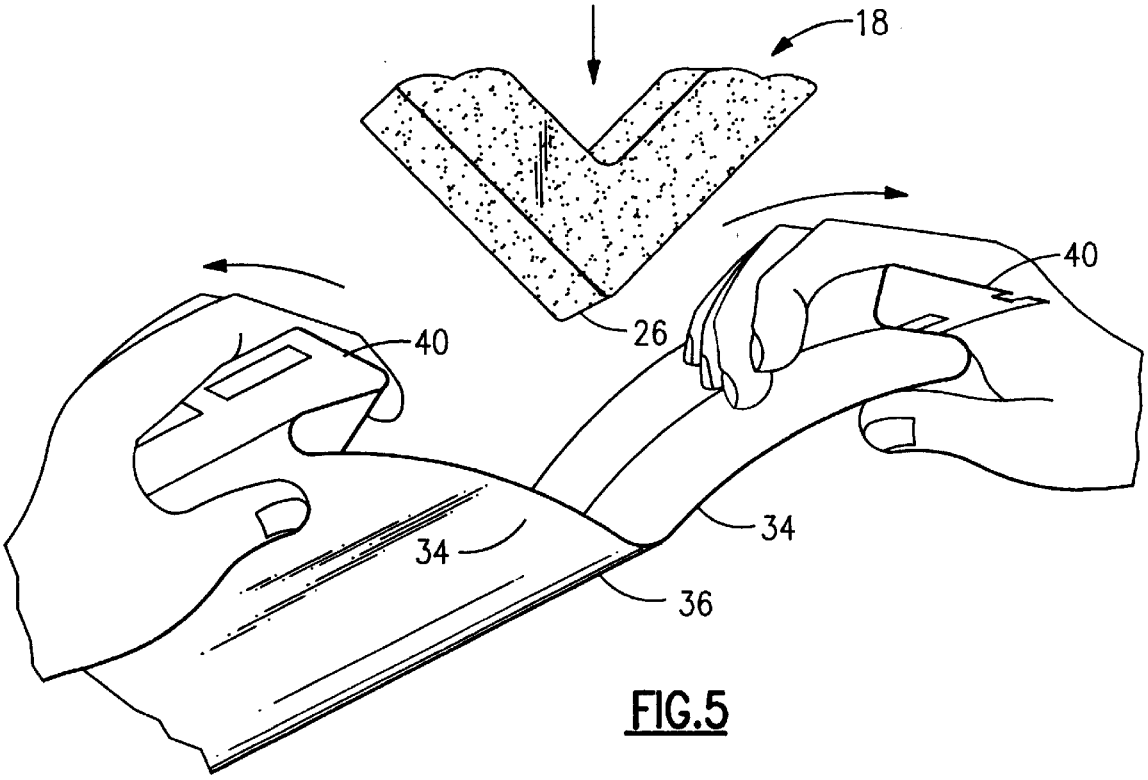
FIGS. 5 and 6 illustrate installation of the insert into the corner moulding.
Figure 6:
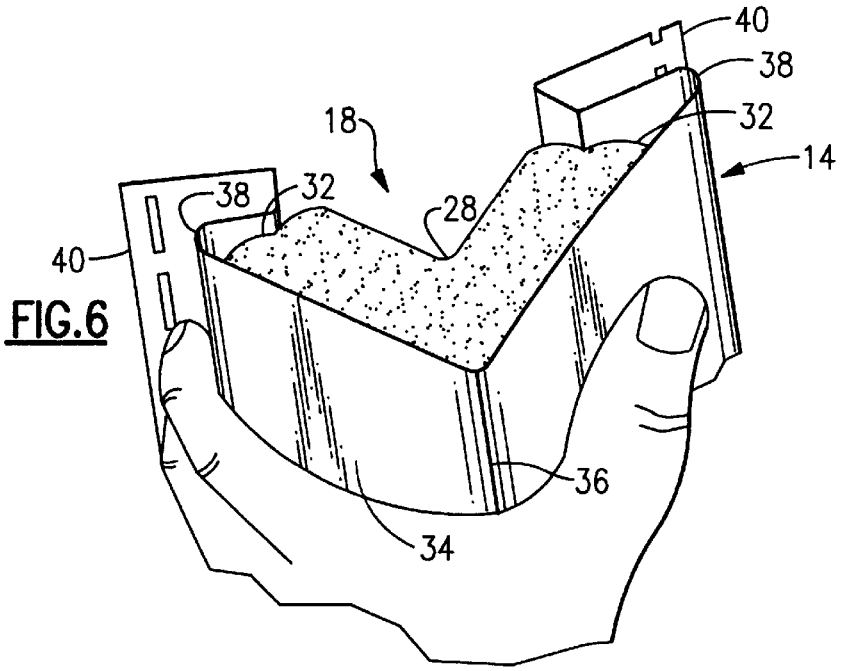

As shown in FIG. 5, the moulding 14 can be flexed open by manually pulling the flanges 40 apart. Then the insert 18 is placed with the ridge 26 oriented against the corner 36 of the web member 34. Ends of the legs 22, 24 fit into the interior of the sharp bends 38. When the corner moulding 14 is released, it returns to its original shape, with the insert compressed in place within one end of the moulding 14, here the upper end as shown in FIG. 6. When the corner moulding is nailed in place, the inside corner or valley 28 is compressed against the corner of the sheathing beneath the moulding 14. The insert closes off the hollow interior of the moulding 14 and blocks drafts of air from moving vertically. The insert also serves as a barrier to insects and other pests from entering behind the corner moulding. The V-shaped notches 32 (FIG. 2) reduce the amount of foam material at the ends of the legs 22, 24, and provide a better fit in corner moulding pieces where the bends 38 are rather narrow.

While this invention has been described with reference to a preferred embodiment, the invention is not limited to that precise embodiment. For example, appropriate foam materials other than foamed polyethylene could be used as desired. The profile and thickness of the inserts can be varied from those of the preferred embodiments. The inserts can be used with other types of siding besides vinyl siding. Many modifications and variations of these embodiments can be carried out by persons skilled in this art without departing from the scope and spirit of this invention, as defined in the appended claims.

We claim:

1. In combination, a corner piece of a synthetic siding of the type that is applied to the exterior of a building, said corner piece being formed of a right angle web member and undercut flange members offset from said web member defining a wedge-shaped void between the flange members and the web member, and each of said undercut flange members defining an elongated recess to receive ends of siding members; and an insert comprising a one-piece resilient, compressible L-shaped foam member of a thickness significantly less than the length of said corner piece, and having legs that compress to fit snugly within respective spaces between the web member and the offset flange members, and defining a valley between said legs that biases against a corner of the building beneath said corner piece, said insert being positioned within one end of said corner piece.

2. The combination of claim 1, and further comprising a second insert that is substantially identical with the first-mentioned insert, and positioned within an opposite end of said corner piece.

3. Insert for use in a corner piece of a synthetic siding of the type that is applied to the exterior of a building; said corner piece being of a length to extend along a corner of the building exterior, and being formed of a right angle web member and undercut flange members offset from said web member defining a wedge-shaped void between the flange members and the web member, and each of said undercut flange members defining an elongated recess to receive ends of siding members; and said insert comprising a one-piece resilient, compressible L-shaped foam member of a thickness significantly less than the length of said corner piece, and having legs that compress to fit snugly within respective spaces between the web member and the offset flange members, and defining a valley between said legs that biases against a corner of the building beneath said corner piece.

4. Insert according to claim 3 wherein the foam member is colored to match the associated corner piece.

5. Insert according to claim 3 wherein said foam member is formed of a foamed polyethylene material.

6. Insert according to claim 5 wherein said foamed polyethylene material includes a UV stabilizer.

7. Insert according to claim 3 wherein the legs of said foam member have chamfers at ends thereof.

8. Insert according to claim 7 wherein the chamfers are formed on the same side of the legs as said valley.

9. Insert according to claim 7 wherein said legs of said foam member have V-notches at ends thereof.

10. Insert for use in a corner piece of a synthetic siding of the type that is applied to the exterior of a building; said corner piece being formed of a right angle web member and undercut flange members offset from said web member defining a wedge-shaped void between the flange members and the web member, and each of said undercut flange members defining an elongated recess to receive ends of siding members; and said insert comprising a one-piece resilient, compressible L-shaped foam member having a thickness on the order of one inch and having legs that compress to fit snugly within respective spaces between the web member and the offset flange members, and defining a valley between said legs that biases against a corner of the building beneath said corner piece.

11. Method of sealing against insects and weather of a corner piece of a synthetic siding of the type that is applied to the exterior of a building; said corner piece having a length sufficient to extend along a corner of the building exterior, and being formed of a right angle web member defining a wedge-shaped void between flange members and the web member, and each of said flange members being undercut and defining an elongated recess to receive ends of siding members; comprising the steps of installing, at ends of said corner piece, resilient, compressible one-piece L-shaped foam inserts, the inserts having a thickness that is significantly less than the length of the corner piece and having legs that compress to fit snugly within respective spaces between the web member and the undercut flange members, and applying said corner piece against a corner of said building such that valleys defined between the legs of each said insert bias against said corner of the building beneath said corner piece.

12. The method of claim 11, comprising installing respective ones of said inserts at upper and at lower ends of said corner piece.

13. Method of sealing against insects and weather of a corner piece of a synthetic siding of the type that is applied to the exterior of a building; said corner piece being formed of a right angle web member defining a wedge-shaped void between flange members and the web member, and each of said flange members being undercut and defining an elongated recess to receive ends of siding members; comprising the steps of installing, at ends of said corner piece, resilient, compressible one-piece L-shaped foam inserts, the inserts having legs that compress to fit snugly within respective spaces between the web member and the undercut flange members, and applying said corner piece against a corner of said building such that valleys defined between the legs of each said insert bias against said corner of the building beneath said corner piece, wherein said siding is a vinyl siding and said corner piece is formed of a flexible vinyl sheet, and said insert is installed by flexing the corner piece to place the insert into said void, and then releasing the corner piece to permit the corner piece to compress the insert within it.

* * * * *